US006161491A

United States Patent [19]

Takenoya et al.

[11] Patent Number: 6,161,491

[45] Date of Patent: Dec. 19, 2000

[54] EMBROIDERY PATTERN POSITIONING APPARATUS AND EMBROIDERING APPARATUS

[75] Inventors: Hideaki Takenoya; Hidechika Kuramoto; Akiyoshi Sasano, all of Hachioji, Japan

[73] Assignee: Janome Sewing Machine Co., Ltd., Tokyo, Japan

[21] Appl. No.: 09/454,892

[22] Filed: Dec. 3, 1999

[30] Foreign Application Priority Data

Dec. 10, 1998 [JP] Japan ..... 10-351277
Dec. 10, 1998 [JP] Japan ..... 10-351278

[51] Int. Cl.[7] ..... D05B 19/08; D05B 21/00

[52] U.S. Cl. ..... 112/102.5; 112/470.04; 112/445; 112/456

[58] Field of Search ..... 112/102.5, 445, 112/470.06, 103, 456, 458, 470.04, 470.01

[56] References Cited

U.S. PATENT DOCUMENTS 5,072,680 12/1991 Nakashima ..... 112/445
5,195,451 3/1993 Nakashima ..... 112/103 X
5,553,559 9/1996 Inoue et al. ..... 112/102.5

*Primary Examiner*—Peter Nerbun
*Attorney, Agent, or Firm*—Nields & Lemack

[57] ABSTRACT

Embroidery pattern positioning apparatus and embroidering apparatus is disclosed, wherein a pattern is projected on a cloth F on which the pattern is embroidered. The projected pattern is moved on the cloth by operation of jog keys 6 to determine a position of the pattern where the pattern is stitched. In the meantime the original position of a carriage is adjusted or the position of the pattern is calculated and memorized in accordance with the moving amount of the pattern. This operation may be repeated as to each of plural patterns selected to be stitched such that a plurality of patterns may be stitched respectively at the positions determined and memorized.

25 Claims, 10 Drawing Sheets

EMBROIDERY PATTERN POSITIONING APPARATUS AND EMBROIDERING APPARATUS

BACKGROUND OF THE INVENTION AND RELATED ART STATEMENT

The invention relates to embroidery pattern positioning apparatus and embroidering apparatus.

In the recent years, the sewing machine having an embroidery stitching function has come to be widely used among the consumers. Such a sewing machine is generally designed to have an embroidery frame which has a cloth held thereon to be embroidered and is moved in the X and Y directions relative to the vertically reciprocating machine needle so that desired patterns, symbols or letters may be stitched on the cloth.

In this case, it is important to attach the cloth to the embroidery frame such that a pattern or patterns may be stitched correctly at a desired position or positions of the cloth. If the cloth is positionally and/or angularly wrong with respect to the embroidery frame, the pattern will be formed at the wrong position and/or wrong angle with respect to the cloth.

This is especially conspicuous when a large pattern or a group of successively stitched patterns is stitched. In this case, it is required to reset the cloth to the embroidery frame so many times that the user will often fail to correctly attach the cloth to the embroidery frame as to the position and/or angle of the pattern to be stitched on the cloth. Thus the stitched pattern will not be smoothly continued and will result in detraction of the appearance.

It is generally known that a template representing a pattern to be stitched, the center of the pattern and the region where the pattern is stitched is used to attach the cloth to the embroidery frame correctly as to the position and/or angle of the pattern with respect to the embroidery frame.

The Japanese patent application Sho 4-72327 filed by the same applicant discloses a method for correctly attaching the cloth to the embroidery frame by using a jig which is called a cross-setter, wherein a cross mark is depicted on the cloth to determine the position and angle of the pattern and then the cloth is attached to the embroidery frame while the cross mark is coincided with the cross provided on the side of the cross-setter.

SUMMARY OF THE INVENTION

However in this method of using a template, it often happens that there is a positional error between the template and the embroidery frame which makes it difficult to obtain a correct positional relation between the cloth the embroidery frame. Moreover it is required to prepare so many templates in connection with different patterns to be stitched. This will add the user so much burden in dealing with so many templates. In case of using the cross-setter, it is admitted that the positioning precision and the operativeness are remarkably increased. However it requires the user to make fine movements of the cloth with respect to the cross-setter before the cloth is attached to the embroidery frame.

The present invention has been provided with the object to eliminate the defects and disadvantages of the prior art as mentioned above.

For attaining the object, the embroidery pattern positioning apparatus of the invention is characterized in comprising means for regulating the positional relation between an embroidering mechanism and a work on which a pattern is stitched, indication means for providing an indication for indicating on at least one of the stitching position and the stitching angle of said pattern to be embroidered on said work which is positionally regulated by said position regulating means, means for moving said indication on said work, and means for producing information which is modified in accordance with the moving amount of said indication to form the stitches of said pattern. Further the embroidering apparatus of the invention is characterized in comprising means for regulating the positional relation between an embroidering mechanism and a work on which a pattern is stitched, indication means for providing an indication for indicating at least one of the position and the angle of said pattern to be embroidered on said work which is positionally regulated by said position regulating means, means for moving said indication on said work, means for producing information which is modified in accordance with the moving amount of said indication to form the stitches of said pattern, means for supplying stitch data for stitching said pattern, and means for stitching said pattern on the basis of said stitch data and said information modified in accordance with the moving amount of said indication.

In the combination of the elements according to the invention as mentioned above, it is preferable to use a projector as the indication means. It is possible to use a device producing a laser ray, or both of the projector and the laser ray producing device. Further as the indication, a pattern itself to be stitched may be used instead of the cross mark or the like of the prior art. If the pattern is indicated with a color, the user is able to know the relation between the color of the pattern and that of the cloth on which the pattern is stitched.

The modified information produced in accordance with the moving amount of the indication may be a modification of the original point of the stitch data or a modification of the stitch data itself. In addition to the modification of the original point of the stitch data, it is possible to produce the information indicating the stitching direction. In case that the stitch data is the relative position data starting from the original stitch starting point, it is most efficient to modify the original stitch starting point. In case that the stitch data is based on the coordinate, the modification is made to the original point of the coordinate or to each stitch data.

In case that the angular displacement of the pattern is accompanied, it is preferable to modify the stitch data. Further it is possible to displace the pattern stitching position by modification of the original stitch starting point and to displace the pattern stitching angle by modification of the stitch data.

In the combination of elements as mentioned above, if a plurality of patterns are sequentially or simultaneously indicated on the work on which the patterns are stitched and are optionally positioned, and then the patterns and the positions thereof are memorized, a plurality of patterns may be successively stitched in the range of the embroidery frame without taking a troublesome task of resetting the work to the embroidering frame so many times.

Further the indication means may provide an indication representing the size of the pattern to be stitched, and may include means for enlarging and reducing the size of the pattern and means for modifying the stitch data in accordance with the enlarged and reduced size of the pattern. Further it is possible to optionally determine the stitching positions and the enlargement/reduction rates of a plurality of patterns respectively.

DETAILED DESCRIPTION OF PREFERRED EMBODIMENTS

The invention will now be described in reference to the attached drawings. The embodiments of the invention will be described as a pattern positioning apparatus being incorporated in a sewing machine which is capable of stitching embroidery patterns. However the invention may be realized by a pattern positioning apparatus singly or by an embroidery stitching apparatus.

Figure 1:
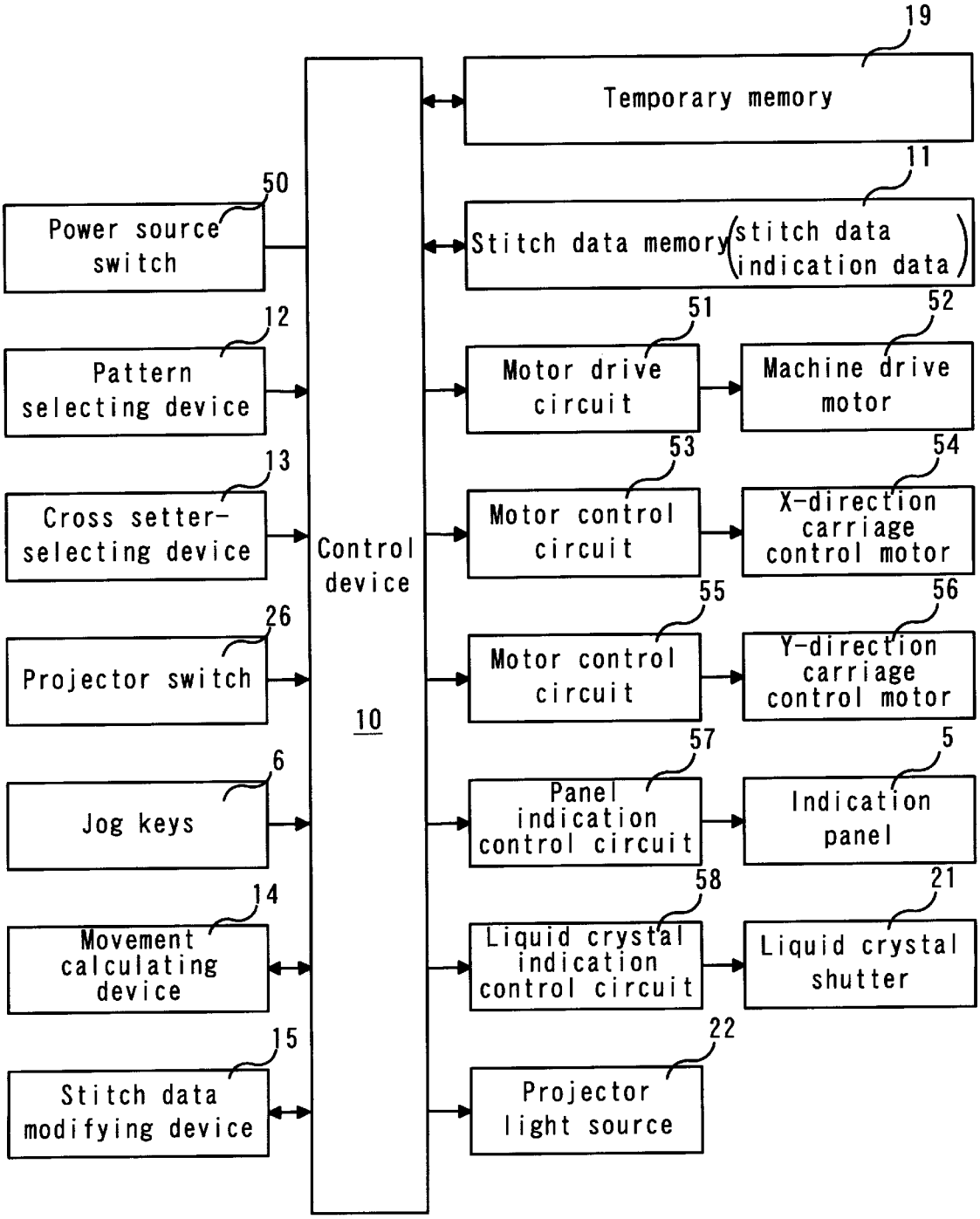
FIG. 1 is a block diagram showing one embodiment of the invention.
Figure 2:
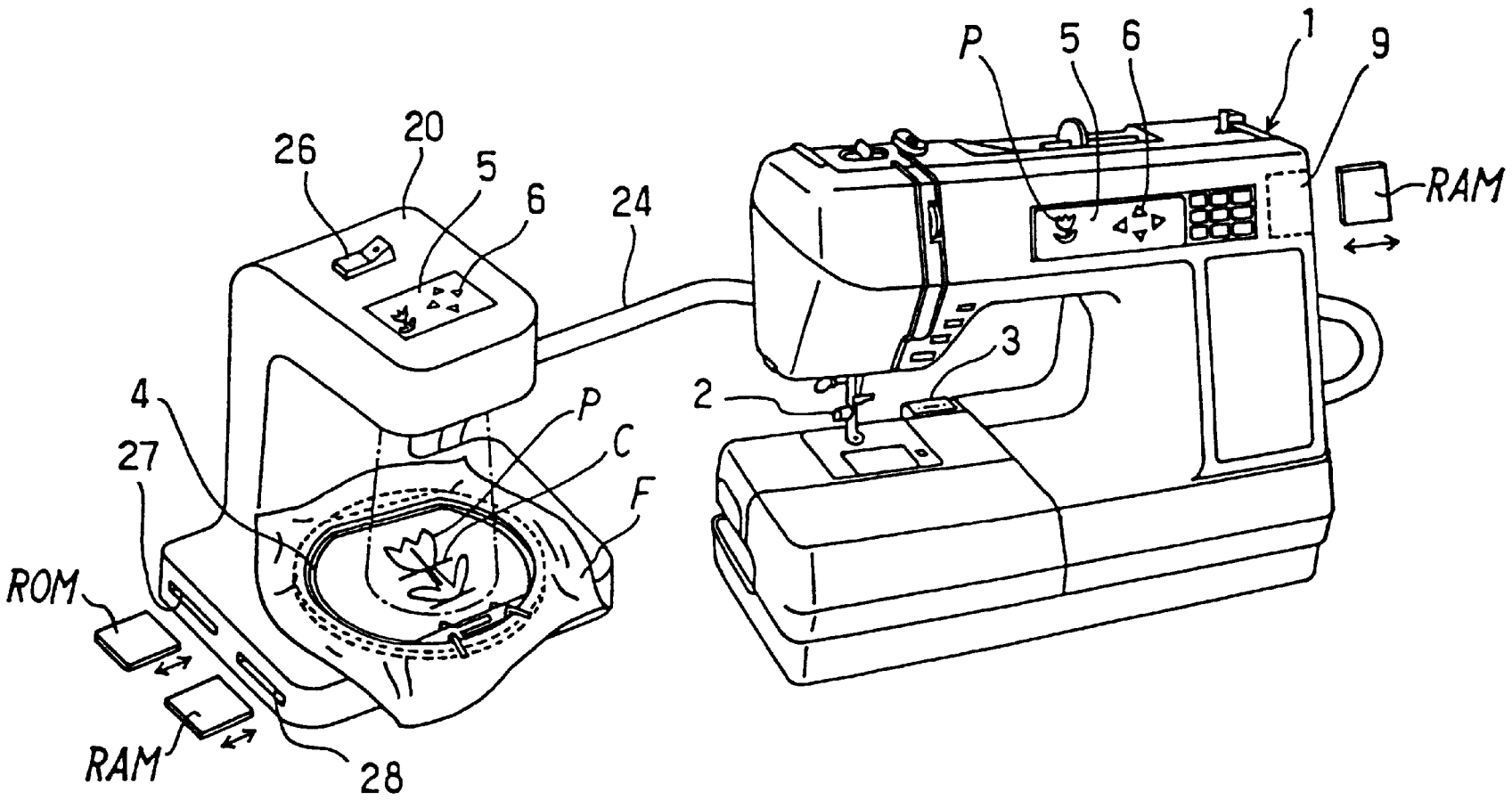
FIG. 2 is a perspective view of the embodiment according to the invention.

In reference to FIGS. 1 and 2, a sewing machine 1 has a control device 10 provided therein for controlling all operations of the sewing machine. The sewing machine is energized as a power source switch 50 is set on and is started for the normal stitching operations as a machine drive motor 52 is driven by a motor drive circuit 51. The embroidery stitching is implemented on the basis of the stitch data which are stored in a stitch data memory 11 and selectively read out for controlling the movements of a carriage 3 which is adapted to have an embroidery frame 4 removably attached thereto. The embroidery frame 4 holds a cloth F to be embroidered thereto and is moved in the X and Y directions relative to a vertically reciprocated machine needle by means of an X-direction carriage motor 54 and an Y-direction carriage motor 56 which may be driven by motor control circuits 53 and 55 respectively.

The control device 10 includes the stitch data memory 11 therein. A pattern selecting device 12 is provided to select a desired pattern P from the stitch data memory 11 to be embroidered and to be indicated at an indication panel 5.

The sewing machine 1 has a cross-setter device 20 connected thereto by means of a cable 24. A cross-setter selecting device 13 is provided to optionally select the functions of the cross-setter device 20. A projector switch 26 may be set on to project a selected pattern.

Figure 4:
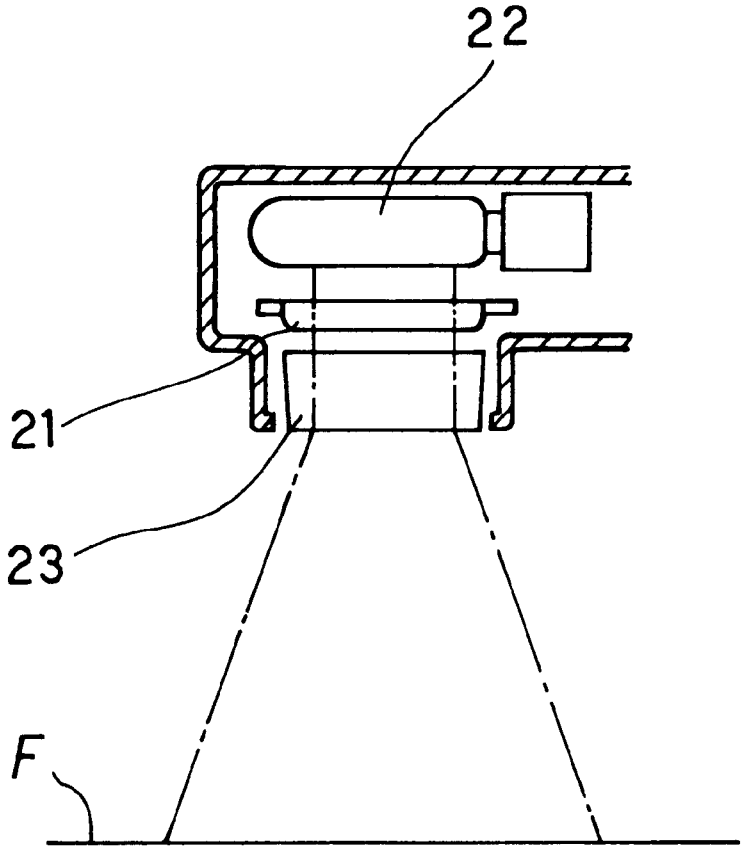
FIG. 4 is a side elevational view of the cross-setter device shown in vertical section to show the inside of the device.

As particularly shown in FIG. 4, a liquid crystal shutter 21 is provided within the cross-setter device 20, so that the liquid crystal shutter 21 may indicate the pattern while the pattern is selected by the pattern selecting device 12 and the indication data for the selected pattern is transmitted to an indication circuit 58. The pattern indicated at the liquid crystal shutter 21 is projected onto the cloth F placed below by means of a light source 22 and a lens 23.

Figure 3:
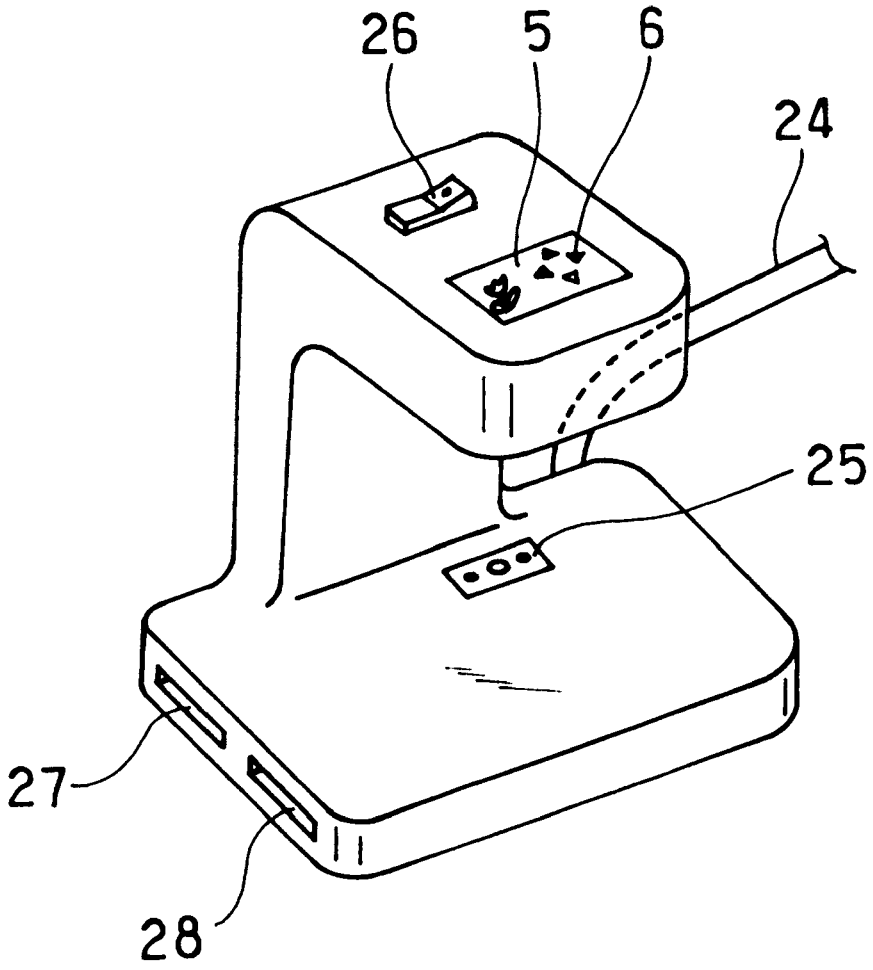
FIG. 3 is a perspective view of a cross-setter device according to the invention.

As particularly shown in FIG. 3, the cross-setter device 20 has an attaching instrument 25 provided at a lower part thereof for removably attach the embroidery frame 4. The position of the attaching instrument 25 is predetermined as a position corresponding to an original position of the carriage 3. It is, therefore, apparent as shown in FIG. 2 that the embroidery frame 4 holding the cloth F and being attached to the attaching instrument 25 is set in a same condition as the embroidery frame 4 is attached to the carriage 3 which is held at the original position on the sewing machine 1 where the needle dropping point (embroidery stitch starting point or original point of the coordinates)corresponds to the original point of embroidery stitching.

FIG. 2 shows that the selected pattern P is projected onto the cloth F so as to be embroidered thereat in the same condition as mentioned above. More precisely the pattern P is projected onto the cloth F with the default values for determining the position and angle of the pattern P to be stitched on the cloth F. If the position and/or angle of the pattern P is not proper with respect to the cloth F, the projected pattern P is positionally and angularly properly moved by use of jog keys 6 provided on the indication panel 5 which may be touchingly operated.

According to the embodiment, a cross C is projected at the same time with the pattern P. The cross C represents the position and angle of the pattern P with respect to the embroidery frame 4. Any one of the pattern P and the cross C may be projected for the same object. For example, the cross C may represent the two orthogonal center lines of the embroidery frame 4, the coordinates of the embroidery frame 4 and the stitch starting point.

As shown in FIG. 1, the jog keys 6 are selectively operated to move the pattern P and the cross C, the movement amount is calculated by the movement calculating device 14. On the basis of the calculation, the control device 10 is operated to produce the data modified to move the carriage 3 from the existing original point to a new original point by means of the X and Y carriage control motors 54 and 56. According to the embodiment, the carriage 3 is moved in synchronism with the pattern P and cross C as the jog keys 6 are optionally operated.

With the movement of the carriage 3, the original stitch starting point and the original coordinate of the pattern P are moved and the pattern P may be stitched at the position where it is projected without modification of the stitch data of the pattern.

According to the embodiment, there is provided a stitch data modifying device 15 which is operated on the basis of the moving amount of the carriage 3, which is calculated out by the movement calculating device 14, to modify the stitch data stored in the stitch data memory 11. The modified stitch data may be stored in the temporary memory 19. The stitch data modified by the stitch data modifying device 15 is used to stitch the pattern P when the pattern P and the cross C are angularly displaced. When the stitch data is modified, the carriage 3 is not moved to displace the original position of the pattern.

It is, however, possible to move the original position of the carriage 3 for displacing the position of the pattern, and to modify the stitch data for displacing the angular position of the pattern.

According to the embodiment, the color of the pattern P may be indicated and may be altered for the purpose of determining the harmony with the color of the cloth on which the pattern is stitched. In this case, it is desirable to provide color data together with the stitch data so that the color of the pattern may be particularly designated when the selected pattern is stitched by the sewing machine 1.

Figure 5:
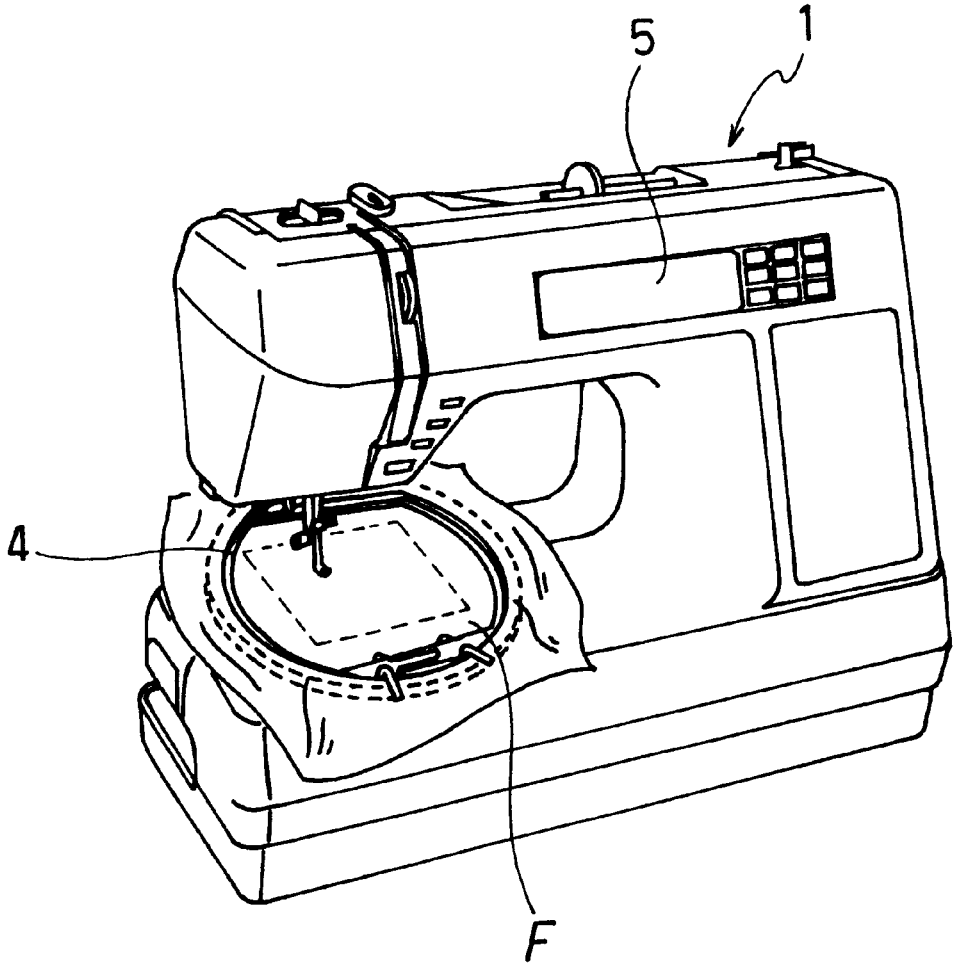
FIG. 5 is a perspective view of a sewing machine showing the implementation of embroidery stitching operation.

Thus the selected pattern is stitched on the cloth F held by the embroidery frame 4 which is attached to the carriage 3 of the sewing machine 1 as shown in FIG. 5. In this case, the original position of the carriage 3 has been already properly displaced in accordance with the movement of the pattern P and the cross C, or the stitch data has been already modified in accordance with the displacement of the carriage 3. In any events, the pattern P is stitched at the position determined at the cross-setter device 20.

According to the embodiment, the cross-setter device 20 may be used separately from the sewing machine 1, wherein the cross-setter device 20 is provided with a ROM card slot 27 which is adapted to receive a ROM card corresponding to the stitch data memory 11, and is further provided with the indication panel 5 and the jog keys 6 and the other necessary operating keys. The data obtained here is stored in a RAM card which is inserted into a RAM card slot 28 of the cross-setter device 20. The Ram card is subsequently inserted into a RAM card slot 9 of the sewing machine 1 so that the sewing machine may be operated to stitch the pattern on the basis of the data stored in the RAM card.

Figure 6:
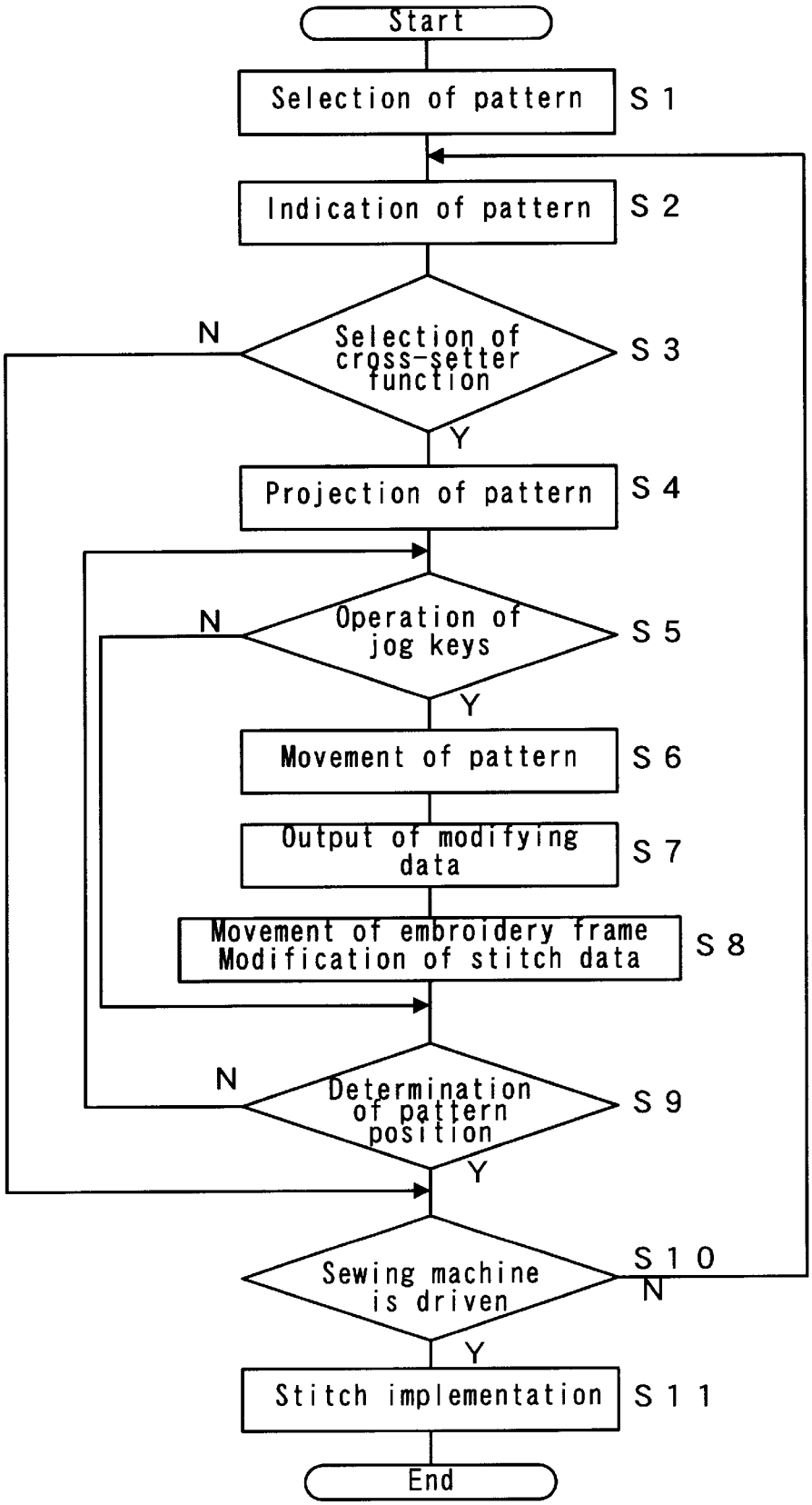
FIG. 6 is a flow chart showing the operations of the embodiment.

The operations of the embodiment will be described in reference to FIG. 6.

When a pattern is selected(step S1), the selected pattern is indicated at the indication panel 5(step S2). When the cross-setter function is selected(step S3), the selected pattern P and the cross C are projected onto the cloth C(step S4). When the user operates the jog keys 6(step S5)to move the pattern P and the cross C(step S6), the control device 10 is operated to produce the modifying data in accordance with the movement amount of the pattern P and the cross C(step S7), and then the carriage 3 and the embroidery frame 4 on the carriage are moved. Simultaneously, or instead with the stitch data modifying device 15 being operated, the stitch data is modified(step S8). When the position of the pattern is determined, the stitching operations are implemented( steps S10,S11).

As described above, the embroidery pattern positioning apparatus and embroidering apparatus of the invention will be easily and correctly operated to determine the positional and angular displacement of a pattern, thereby to increase the embroidery stitching precision.

The following description is about another embodiment of the invention for embroidering a plurality of patterns P of different stitch data.

Figure 9:
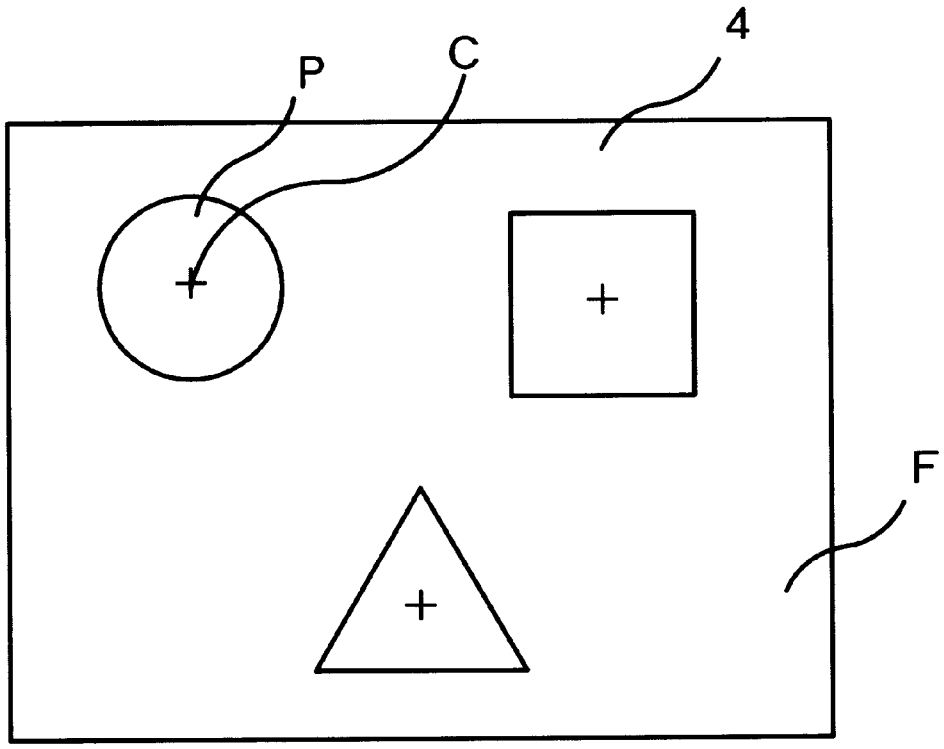
FIG. 9 is a plan elevational view of a plurality of patterns and a work showing the positional arrangement of the patterns on the work in accordance with the second embodiment of the invention.

In reference to FIG. 9, for example, according to the prior art, in case that the circular, triangular and square patterns of so many different data are to be stitched in the range of the embroidery frame 4, it is required to remove the cloth F from the embroidery frame 4 and reset the former to the latter with displacement of the former with respect to the latter. In this embodiment, these patterns are projected onto the cloth F one after another. The position of each pattern P where the pattern is stitched is determined with movement of the cross C. Each position of each pattern is memorized in the original position/modified stitch data memory 16. Thus the embodiment will not require to reset the cloth C to the embroidery frame 4.

In this embodiment also when the jog keys 6 are likewise operated to move the patterns together with the crosses C, the moving amounts are calculated by the movement calculating device 14. The new original positions of the patterns determined by the calculations are memorized in the original position/modified stitch data memory 16. In case that a single pattern is stitched, the carriage 3 may be moved in synchronism with the movement of the pattern P and the cross C as described in connection with the first embodiment as mentioned above.

On the basis of the moving amounts of the patterns as calculated by the movement calculating device 14, the stitch data modifying device 15 is operated to modify the stitch data stored in the stitch data memory 11. The modified stitch data is stored in the original position/modified stitch data memory 16.

The calculated original positions and the modified stitch data are stored in the original position/modified stitch data memory 16 in a manner as connected with the stitch data of the patterns. The user repeats the operations as to each of the patterns to be stitched in the range of the embroidery frame 4 so as to store the so many patterns in the original position/modified stitch data memory 16. Thus a plurality of patterns may be successively stitched in the range of the embroidery frame 4 on the basis of the stored contents.

Figure 7:
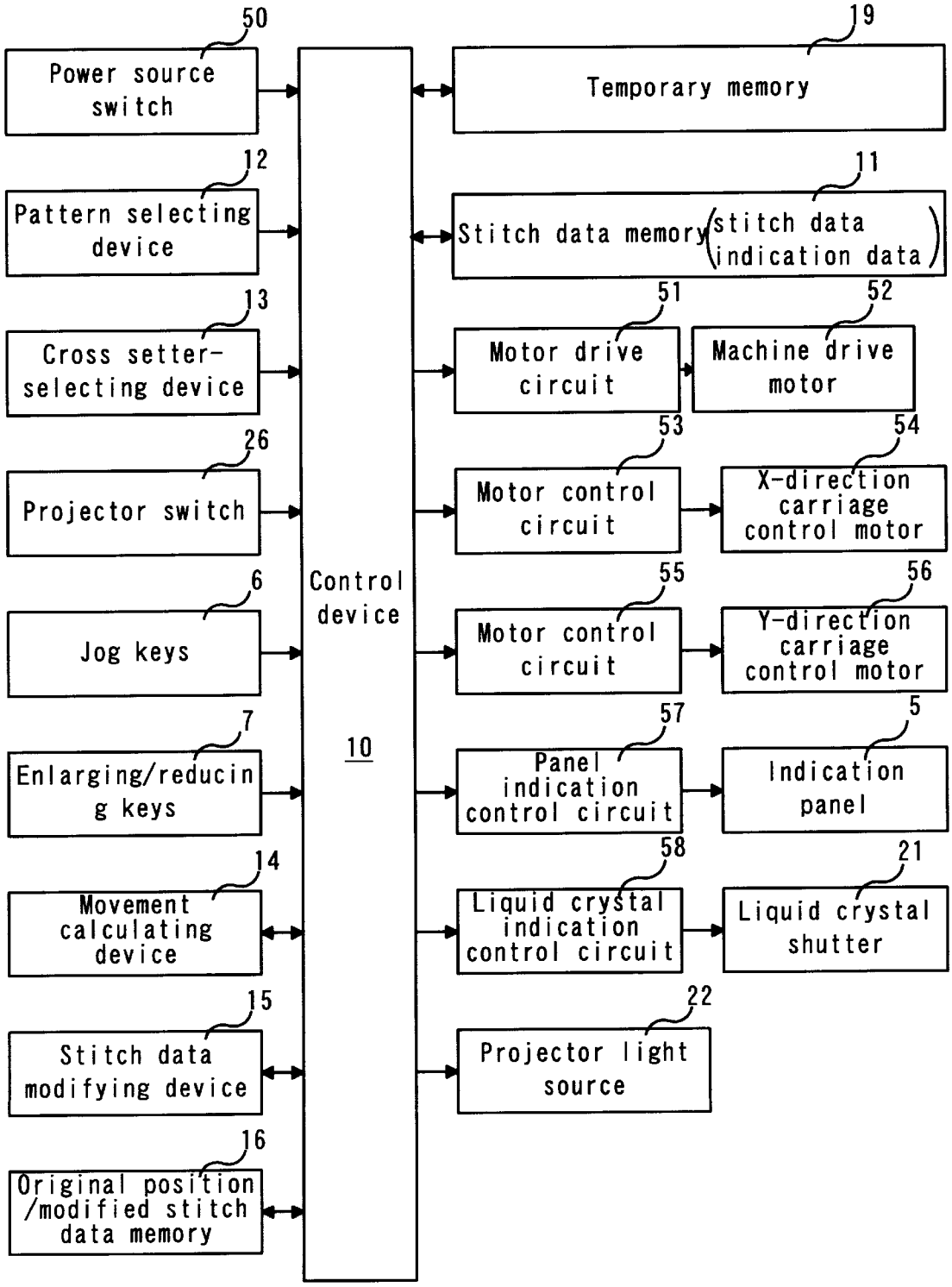
FIG. 7 is a block diagram showing a second embodiment of the invention.
Figure 8:
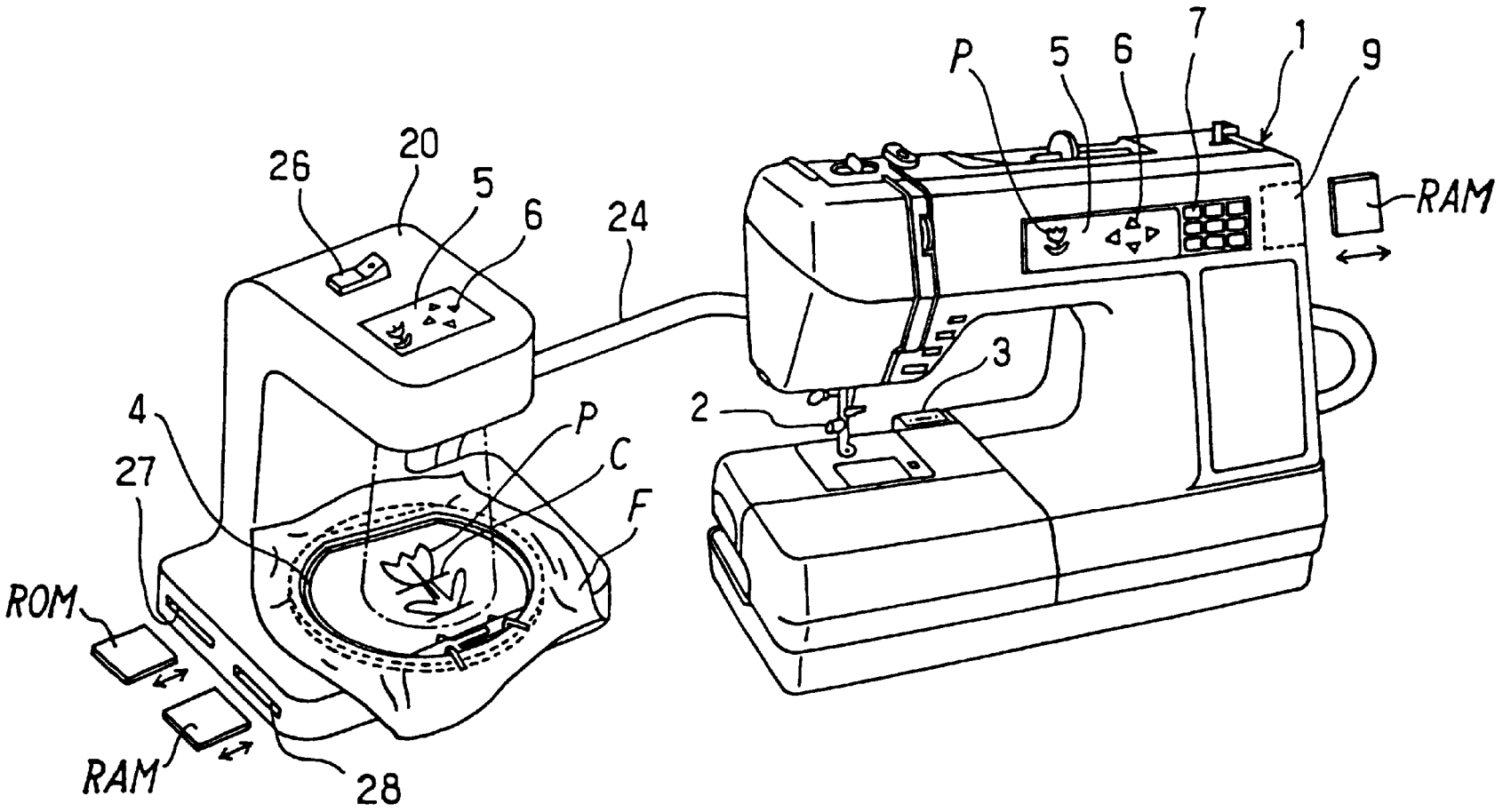
FIG. 8 is a perspective view of the second embodiment according to the invention.

Further the embodiment is provided with enlarging/reducing keys 7 as shown in FIGS. 7 and 8 which are operated to enlarge or reduce the size of the patterns to be stitched. In response to the operations of the enlarging/reducing keys 7, the stitch data modifying device 15 is operated to modify the stitch data, and the modified stitch data is stored in the original position/modified stitch data memory 16. Thus the user is able to optionally enlarge or reduce the size of the selected patterns to be stitched.

Subsequently the embroidery frame 4 is mounted on the carriage 3 of the sewing machine 1 as shown in FIG. 5. In this case, the selected patterns are embroidered with the original positions of the carriage 3 as stored in the original position/modified stitch data memory 16 or with the stitch data modified and stored in the original position/modified stitch data memory 16 as the patterns have been moved with the crosses C.

As the embodiment shown in FIGS. 7 and 8 is same with the first embodiment as shown in FIGS. 1 and 2 except for the enlarging/reducing keys 7 and the original position/modified stitch data memory 16, the further description will be abbreviated. The design as shown in FIGS. 3 and 4 is adapted to the embodiment as shown in FIGS. 7 and 8.

Figure 10:
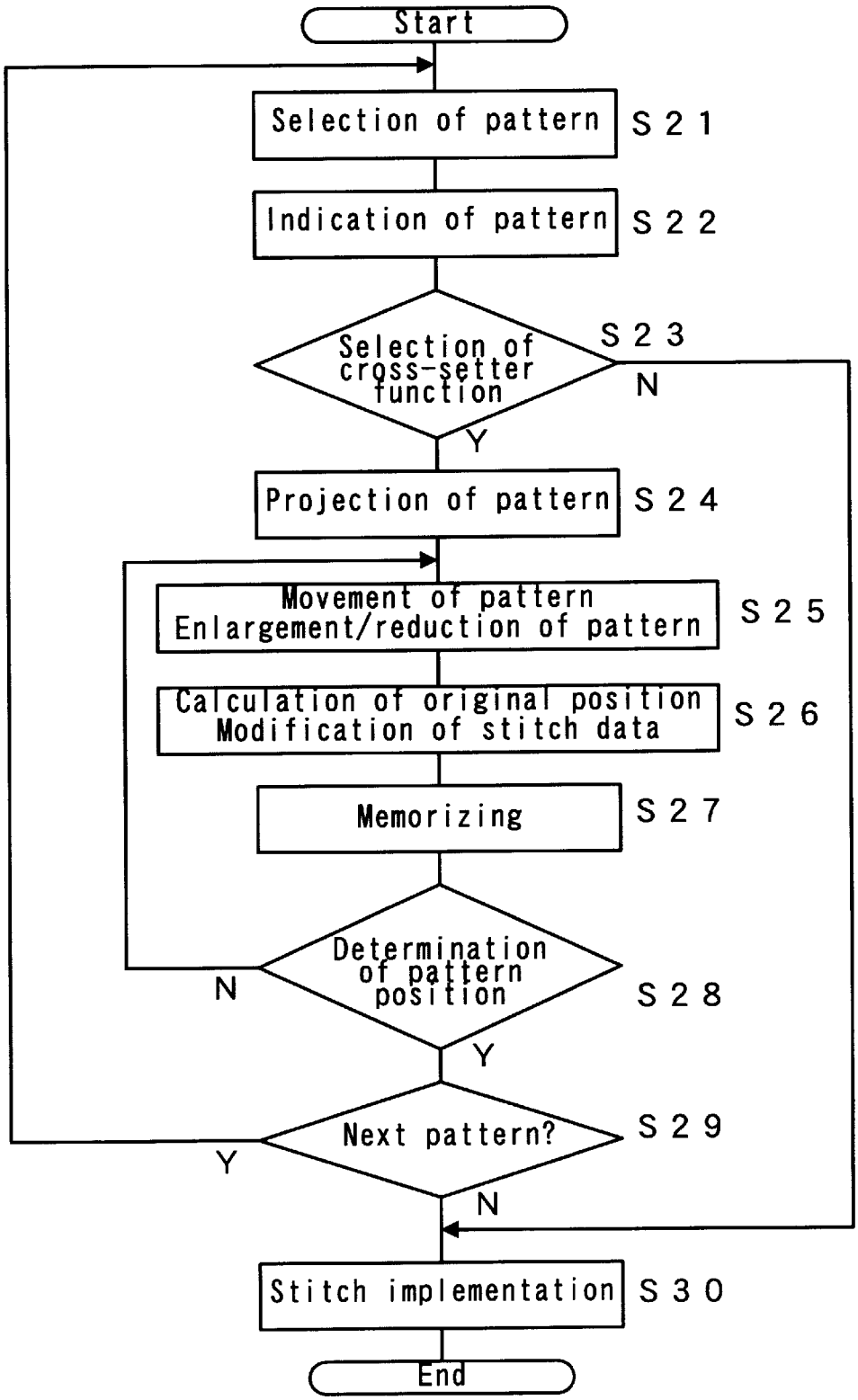
FIG. 10 is a flow chart showing the operations of the second embodiment of the invention.

The operations of this embodiment will be described in reference to FIG. 10.

When the patterns are selected(step S21), the selected patterns are indicated at the indication panel 5(step S22). Subsequently when the cross-setter function is selected(step S23), the selected patterns P and the respective crosses C are projected onto the cloth F(step S24). Subsequently when the jog keys and the enlarging/reducing keys 7 are operated to move and/or angularly displace one of the patterns P and the cross C and enlarge or reduce the pattern P(step S25), the original position and the stitch data of the pattern are modified in accordance with the moving amount and the rate of enlargement or reduction of the pattern(step S26), and the modified original position and stitch data are memorized in the original position/modified stitch data memory 16(step S27). If the position and size of the pattern have been decided(step S28), the same operations are repeated as to the next of the selected patterns(step S29). If there is no next pattern to be dealt with, the stitching operation is implemented(step S30).

As described above, the embroidery pattern positioning apparatus and embroidering apparatus of the invention will be easily and correctly operated to determine the positional and angular displacement of a pattern, thereby to increase the embroidery stitching precision. Further in case a plurality of patterns are to be stitched in the range of the embroidery frame, it is possible to optionally position and arrange these patterns in a desired combination without taking a work of resetting the cloth to the embroidery frame each time to deal with a pattern. Thus the selected plural patterns will be correctly stitched at the optional positions and with optional angles.

What is claimed is:

1. An apparatus for positioning an embroidery pattern to be embroidered on a work by an embroidering mechanism, comprising:

means for emulating the positional relation between said embroidering mechanism and said work when said work is set on the mechanism, indication means for providing an indication for indicating at least one of the stitching position and the stitching angle of said pattern to be embroidered on said work which is positioned by said position regulating means, means for moving said indication on said work, and means for producing information for modifying stitch data in accordance with the moving amount of said indication to form the stitches of said pattern.

2. The apparatus as defined in claim 1, wherein said indication means includes a projector for projecting said indication onto said work.

3. The apparatus as defined in claims 1 and 2, wherein said indicator moving means is operated to move said indication projected by said projector.

4. The apparatus as defined in claim 1, wherein said indication represents a configuration of said pattern.

5. The apparatus as defined in claim 1, wherein said indication represents said pattern with a color.

6. The apparatus as defined in claim 1, wherein said modifying information includes the information concerning at least one of said position and said angle of said pattern.

7. The apparatus as defined in claim 1, wherein said modifying information includes the modifying data concerning an original stitch position of said pattern.

8. The apparatus as defined in claim 7, wherein said original stitch position is an original stitch starting point or an original stitch coordinate of said pattern.

9. The apparatus as defined in claim 1, wherein said modifying information includes the modifying data concerning the stitch data of said pattern.

10. The apparatus as defined in claim 1, wherein said modifying information includes the modifying data concerning the stitching position of said pattern and the modifying data concerning the stitch data of said pattern.

11. The apparatus as defined in claim 1, wherein said means for regulating the positional relation between said embroidering mechanism and said pattern includes;

an embroidery frame for holding said work on which said pattern is embroidered, and means for fixedly holding said embroidery frame at a position corresponding to a position where said embroidery frame is connected to said embroidering mechanism.

12. The apparatus as defined in claim 1, further comprising;

means for supplying stitch data for stitching said pattern, means for modifying said stitch data on the basis of said modifying information, and means for producing the stitch data modified by said stitch data modifying means.

13. An apparatus for positioning an embroidery pattern to be embroidered on a work by an embroidering mechanism, comprising:

means for emulating the positional relation between said embroidering mechanism and said work when said work is set on the mechanism, indication means for providing an indication for indicating at least one of the position and the angle of said pattern to be embroidered on said work which is positioned by said position regulating means, means for moving said indication on said work, means for producing information for modifying the stitch data of said pattern in accordance with the moving amount of said indication to form the stitches of said pattern, means for supplying stitch data for stitching said pattern, and means for stitching said pattern on the basis of said stitch data and said information modified in accordance with the moving amount of said indication.

14. The apparatus as defined in claim 13, wherein said modified information includes the modified data of an original stitch position of said pattern, and said pattern stitching means includes a mechanism for supporting and moving said work, said mechanism having an original stitch position moved in accordance with the movement of said indication on said work.

15. An apparatus for positioning an embroidery pattern to be embroidered on a work by an embroidering mechanism, comprising:

means for emulating the positional relation between said embroidering mechanism and said work when said work is set on the mechanism, indication means for providing an indication for indicating at least one of the stitching position and the stitching angle of said pattern to be embroidered on said work which is positioned by said position regulating means, means for moving said indication on said work, and means for calculating out at least one of the stitching position and the stitching angle of said pattern in accordance with the moving amount of said indication, and means for memorizing at least one of said calculated position and angle of said pattern as the stitching position and/or angle of said pattern.

16. The apparatus as defined in claim 15, wherein said indication means is capable of providing more than two indications to said work which is positionally regulated by said position regulating means, said more than two indications representing the existence of more than two patterns to be stitched on said work, said indication moving means is capable of individually moving said more than two indications, said calculating means calculates at least one of the stitching position and the stitching angle of each pattern, and said memorizing means memorizes at least one of the calculated stitching position and stitching angle of each pattern as the stitching position and/or angle of each pattern.

17. The apparatus as defined in claim 15, wherein said indication means further provides an indication representing the size of said pattern, said indication means including means for enlarging and reducing said indication and means for producing information for modifying the stitch data of said pattern in accordance with the degree of enlargement and reduction of said pattern.

18. The apparatus as defined in claim 15, wherein said indication means includes a projector for projecting said indication onto said work.

19. The apparatus as defined in claim 15, wherein said indication moving means is operated to move said indication which is projected by said projector.

20. The apparatus as defined in claim 15, wherein said indication represents the configuration of said pattern.

21. The apparatus as defined in claim 15, wherein said indication represents said pattern with a color.

22. The apparatus as defined in claim 15, wherein said calculating means calculates out a position of the original stitch point of said pattern.

23. The apparatus as defined in claim 22, wherein said original stitch point of said pattern is an original stitch starting point or an original stitch coordinate of said pattern.

24. The apparatus as defined in claim 15, further comprising means for producing information for modifying the stitch data of said pattern in accordance with at least one of the stitching position and the stitching angle of said pattern which are calculated out by said calculating means.

25. An embroidering apparatus having an embroidering mechanism for embroidering a pattern on a work, said apparatus comprising:

means for regulating the positional relation between said embroidering mechanism and said work, indication means for providing an indication for indicating the stitching position and the stitching angle of said pattern to be embroidered on said work which is positionally regulated by said position regulating means, means for moving said indication on said work, and means for calculating out the stitching position and the stitching angle of said pattern in accordance with the moving amount of said indication, means for memorizing said calculated position and angle of said pattern as the stitching position and angle of said pattern, and means for stitching said pattern at the stitching position and with the stitching angle memorized in said memorizing means.

* * * * *